US009009969B2

(12) United States Patent
Choi et al.

(10) Patent No.: US 9,009,969 B2
(45) Date of Patent: Apr. 21, 2015

(54) REFRIGERATOR AND HANDLE ASSEMBLY METHOD THEREOF

(71) Applicant: Samsung Electronics Co., Ltd., Suwon-si (KR)

(72) Inventors: Nam Gu Choi, Jeonju-si (KR); Dong Gyun Kim, Gwangju (KR); Hyo Sik Kang, Gwangju (KR); Young Gwi Park, Gwangju (KR); Jong Sun Park, Gwangju (KR); Yong Man Seo, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/870,393

(22) Filed: Apr. 25, 2013

(65) Prior Publication Data

US 2013/0285527 A1 Oct. 31, 2013

(30) Foreign Application Priority Data

Apr. 27, 2012 (KR) ..... 10-2012-0044224

(51) Int. Cl.
*B21D 53/06* (2006.01)
*F25D 23/02* (2006.01)
*F25D 23/00* (2006.01)

(52) U.S. Cl.
CPC ..... *F25D 23/028* (2013.01); *F25D 23/00* (2013.01)

(58) Field of Classification Search
USPC ..... 29/890.035, 525.01, 525.02, 525.11; 16/110.1, 412, 413, 430
See application file for complete search history.

(56) References Cited

U.S. PATENT DOCUMENTS

| | | | | |
|---|---|---|---|---|
| 3,152,818 | A * | 10/1964 | Ivins | 403/362 |
| 4,912,809 | A * | 4/1990 | Scheuer | 16/413 |
| 5,797,164 | A * | 8/1998 | Donaghy | 16/412 |
| 6,430,780 | B1 * | 8/2002 | Kim et al. | 16/412 |
| 7,549,713 | B2 * | 6/2009 | Gose et al. | 312/405 |
| 7,992,257 | B2 * | 8/2011 | Kim | 16/412 |
| 8,813,995 | B2 * | 8/2014 | Kim et al. | 220/592.02 |
| 2008/0034553 | A1 | 2/2008 | Wing | |

FOREIGN PATENT DOCUMENTS

| | | |
|---|---|---|
| KR | 10-2006-0054933 | 5/2006 |
| KR | 10-2009-0006517 | 1/2009 |
| KR | 10-2009-0051800 | 5/2009 |

OTHER PUBLICATIONS

Machine Translation of Park (KR20090051800A) Nov. 20, 2007.*

* cited by examiner

*Primary Examiner* — Ryan J Walters
(74) *Attorney, Agent, or Firm* — Staas & Halsey LLP

(57) ABSTRACT

A refrigerator which increases convenience in assembly of a handle and reduces generation of scratches on doors and drawers in assembly of the handle, and a handle assembly method thereof, is provided. The refrigerator includes doors rotatably combined with a main body, a handle combined with each door to open and close each door, a first handle fixing unit assembled with each door to fix the handle to each door and provided with an inclined part fixed to the handle by a fastening unit, a second handle fixing unit assembled with each door to fix the handle to each door and combined with the handle in a sliding manner, a first connector assembled with the handle and fastened to the first handle fixing unit by the fastening unit, and a second connector assembled with the handle and combined with the second handle fixing unit in the sliding manner.

1 Claim, 13 Drawing Sheets

REFRIGERATOR AND HANDLE ASSEMBLY METHOD THEREOF

CROSS-REFERENCE TO RELATED APPLICATIONS

This application claims the benefit of Korean Patent Application No. 10-2012-0044224, filed on Apr. 27, 2012 in the Korean Intellectual Property Office, the disclosure of which is incorporated herein by reference.

BACKGROUND

1. Field

Embodiments relate to a refrigerator and a handle assembly method thereof.

2. Description of the Related Art

In general, a refrigerator includes storage chambers and a cold air supply apparatus supplying cold air to the storage chambers, and thus stores foods in a fresh state. The storage chambers are divided into a refrigerating chamber and a freezing chamber so as to store food in a refrigerated state or in a frozen state according to states of the food to be stored.

The front surfaces of such storage chambers of the refrigerator are opened, and the opened front surfaces are opened and closed by doors rotatably combined with a main body of the refrigerator or drawers slidably combined with the main body.

A handle facilitating user manipulation is mounted on the door or the drawer. The handle is assembled in a manner that both ends of the handle are fastened to handle inner structures and mounts of the door or the drawer by separate screws. Alternatively, the handle is assembled in a sliding manner without fastening to the handle inner structures and mounts of the door or the drawer by separate screws.

If both ends of the handle are fastened by screws, both ends of the handle need to be fastened by the screws and thus convenience in assembly is lowered. In addition, both ends of the handles are provided with screw holes and thus external appearance of the refrigerator is poor.

If both ends of the handle are fastened in the sliding manner, fastening using screws is omitted and thus convenience in assembly is high. However, when the handle is assembled with a small force, the handle may be separated from the door or the drawer or a gap may be generated between the handle and the door or the drawer.

Further, when the handle is assembled with a large force, assembly of the handle is difficult and scratches may be easily generated on the surface of the door or the drawer.

SUMMARY

In an aspect of one or more embodiments, there is provided a refrigerator which reduces the number of fastening units to increase convenience in assembly of a handle and reduces generation of scratches on the surface of a door or a drawer in assembly of the handle, and a handle assembly method thereof.

In accordance with an aspect of one or more embodiments, there is provided a refrigerator which includes a main body, doors rotatably combined with the main body and opening and closing the main body, a handle combined with each door to open and close each door, a first handle fixing unit assembled with each door to fix the handle to each door and provided with an inclined part fixed to one end of the handle by a fastening unit, a second handle fixing unit assembled with each door to fix the handle to each door and combined with the other end of the handle, a first connector assembled with one end of the handle and fastened to the first handle fixing unit by the fastening unit to combine the handle with each door, and a second connector assembled with the other end of the handle and combined with the second handle fixing unit by sliding the second handle fixing unit and the second connector together to combine the handle with each door.

The handle may have a hollow cylindrical shape, be formed in an arc shape in which the central part of the handle is protruded farther forward than both ends of the handle and be combined with the front surface of each door, and the first connector and the second connector may be accommodated in both ends of the handle and are assembled with the handle.

A fastening part to which the first connector or the second connector is fastened, and guide rails guiding the first connector or the second connector may be provided at each of both ends of the handle.

The first handle fixing unit may include a combining part combined with each door and an insertion part protruded from the front surface of the combining part and inserted into the first connector, and the insertion part includes a body part and a head part protruded from the front surface of the body part so as to have a greater diameter than the body part.

The inclined part may be inclined such that the diameter thereof is gradually decreased between the head part and the body part in a direction from the lower portion of the head part toward the combining part, a first fastening hole and a second fastening hole may be provided on the first connector and the handle at positions corresponding to the inclined part, and the handle may be fixed to the first handle fixing unit by allowing the fastening unit inserted into the first fastening hole and the second fastening hole to move from a portion of the inclined part having a large diameter to a portion of the inclined part having a small diameter along the inclined surface of the inclined part.

The first connector may include an insertion recess into which the insertion part is inserted, a fastening groove fastened to the fastening part by a fastening member, and guide parts guided by the guide rails, and the first fastening hole may be formed through one side surface of the insertion recess.

The second handle fixing unit may include a combining part combined with each door and an insertion part protruded from the front surface of the combining part and inserted into the second connector, and the insertion part may include a body part and a head part protruded from the front surface of the body part so as to have a greater diameter than the body part.

The second connector may include an insertion recess having a size corresponding to the diameter of the head part so that the insertion part may be inserted into the insertion recess, and a guide groove having a size corresponding to the diameter of the body part and guiding movement of the body part.

The second connector may further include a fastening groove fastened to the fastening part of the handle by a fastening member, and guide parts guided by the guide rails.

In accordance with an aspect of one or more embodiments, there is provided a refrigerator which includes a main body, drawers slidably combined with the main body and opening and closing the main body, a handle combined with each drawer to open and close each drawer, a first handle fixing unit assembled with each drawer to fix the handle to each drawer and provided with an inclined part fixed to one end of the handle by a fastening unit, a second handle fixing unit assembled with each drawer to fix the handle to each drawer and combined with the other end of the handle, a first connector assembled with one end of the handle and fastened to the first handle fixing unit by the fastening unit to combine the handle with each drawer, and a second connector assembled with the other end of the handle and combined with the second handle fixing unit by sliding the second handle fixing unit and the second connector together to combine the handle with each drawer.

The handle may have a hollow cylindrical shape, be formed in an arc shape in which the central part of the handle is protruded farther forward than both ends of the handle and be combined with the front surface of each drawer, and the first connector and the second connector may be accommodated in both ends of the handle and are assembled with the handle.

A fastening part to which the first connector or the second connector is fastened, and guide rails guiding the first connector or the second connector may be provided at each of both ends of the handle.

The first handle fixing unit may include a combining part combined with each drawer and an insertion part protruded from the front surface of the combining part and inserted into the first connector, and the insertion part may include a body part and a head part protruded from the front surface of the body part so as to have a greater diameter than the body part.

The inclined part may be inclined such that the diameter thereof is gradually decreased between the head part and the body part in a direction from the lower portion of the head part toward the combining part, a first fastening hole and a second fastening hole may be provided on the first connector and the handle at positions corresponding to the inclined part, and the handle may be fixed to the first handle fixing unit by allowing the fastening unit inserted into the first fastening hole and the second fastening hole to move from a portion of the inclined part having a large diameter to a portion of the inclined part having a small diameter along the inclined surface of the inclined part.

The first connector may include an insertion recess into which the insertion part is inserted, a fastening groove fastened to the fastening part by a fastening member, and guide parts guided by the guide rails, and the first fastening hole may be formed through one side surface of the insertion recess.

The second handle fixing unit may include a combining part combined with each drawer and an insertion part protruded from the front surface of the combining part and inserted into the second connector, and the insertion part may include a body part and a head part protruded from the front surface of the body part so as to have a greater diameter than the body part.

The second connector may include an insertion recess having a size corresponding to the diameter of the head part so that the insertion part may be inserted into the insertion recess, and a guide groove having a size corresponding to the diameter of the body part and guiding movement of the body part.

The second connector may further include a fastening groove fastened to the fastening part of the handle by a fastening member, and guide parts guided by the guide rails.

In accordance with an aspect of one or more embodiments, there is provided a handle assembly method of a refrigerator which has a main body, doors rotatably combined with the main body and opening and closing the main body, and a handle combined with each door to open and close each door, includes assembling a first handle fixing unit and a second handle fixing unit with positions of each door corresponding to both ends of the handle, assembling a first connector and a second connector with both ends of the handle, inserting a body part of the second handle fixing unit into a guide groove of the second connector by slidably moving the handle toward the assembly position of the second handle fixing unit with each door, after insertion of an insertion part of the second handle fixing unit into an insertion recess of the second connector assembled with one end of the handle, and inserting an insertion part of the first handle fixing unit into an insertion recess of the first connector assembled with the other end of the handle, and then combining the handle with the first handle fixing unit by a fastening unit.

During the insertion of the insertion part of the second handle fixing unit into the insertion recess of the second connector, interference between the other end of the handle and the first handle fixing unit may be prevented by inserting the insertion part of the second handle fixing unit into the insertion recess of the second connector, after drawing of the upper portion of the handle in the forward direction.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1:
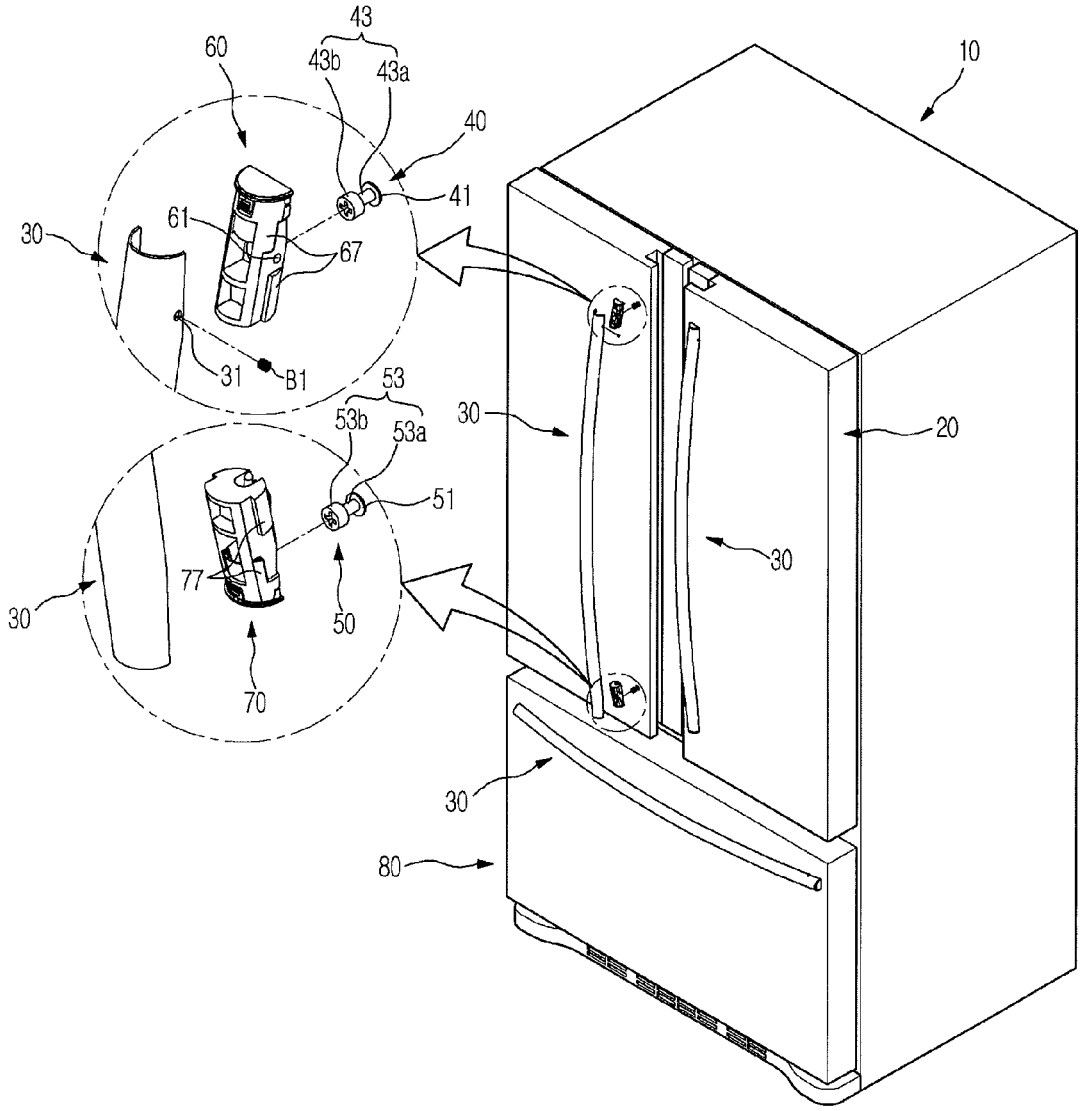
FIG. 1 is a perspective view of a refrigerator in accordance with embodiment.

Reference will now be made in detail to embodiments, examples of which are illustrated in the accompanying drawings, wherein like reference numerals refer to like elements throughout.

As shown in FIG. 1, a refrigerator in accordance with an embodiment includes a main body 10, doors 20 rotatably combined with the main body 10 and opening and closing the main body 10, a handle 30 combined with each door 20 to open and close each door 20, a first handle fixing unit 40 and a second handle fixing unit 50 assembled with each door 20 and combined with the handle 30, a first connector 60 assembled with one end of the handle 30 and combined with the first handle fixing unit 40, and a second connector 70 assembled with the other end of the handle 30 and combined with the second handle fixing unit 50.

The main body 10 includes an inner case (not shown) forming storage chambers (not shown) and an outer case (not shown) forming the external appearance of the main body 10, and the doors 20 and a drawer 80 are combined with the main body 10 so as to open and close the storage chambers, front surfaces of which are opened.

The doors 20 are rotatably combined with the main body 10 and open and close the corresponding storage chamber, and the drawer 80 is slidably combined with the main body 10 and opens and close the corresponding storage chamber.

The handle 30 gripped by user so as to easily open and close the doors 20 and the drawer 80 is combined with the doors 20 and the drawer 80.

Figure 2:
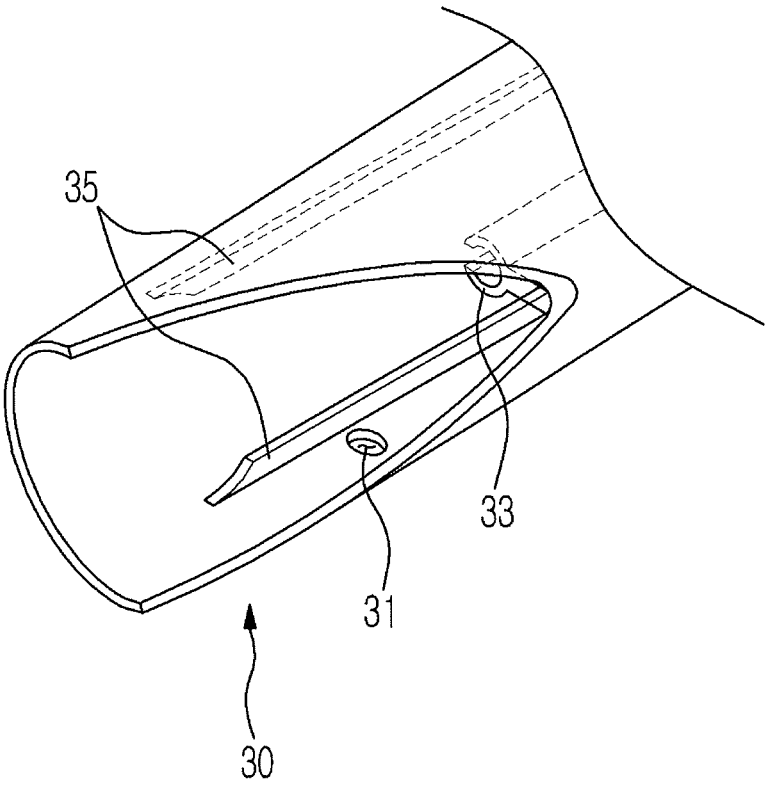
FIG. 2 is a view illustrating a handle in accordance with an embodiment.

As shown in FIGS. 1 and 2, the handle 30 has a hollow cylindrical shape, is formed in an arc shape in which the central part of the handle 30 is protruded farther forward than both ends of the handle 30 so as to allow a user to easily grip the handle 30, and is combined with the front surfaces of the doors 20 and the drawer 80.

The handle 30 includes a second fastening hole 31 into which a fastening unit B1 is inserted so as to fix the first connector 60 or the second connector 70 combined with the handle 30 to the first handle fixing unit 40 or the second handle fixing unit 50, fastening parts 33 fastened to the first connector 60 and the second connector 70, and guide rails 35 guiding the first connector 60 and the second connector 70 so that the first and second connectors 60 and 70 are easily accommodated within the handle 30.

The first connector 60 and the second connector 70 to combine the handle 30 with the door 20 or the drawer 80 are combined with the vacant inner space of the handle 30, and a detailed description thereof will be described later.

In order to combine the handle 30 with the door 20, the first handle fixing unit 40 and the second handle fixing unit 50 are assembled with the door 20.

Figure 3:
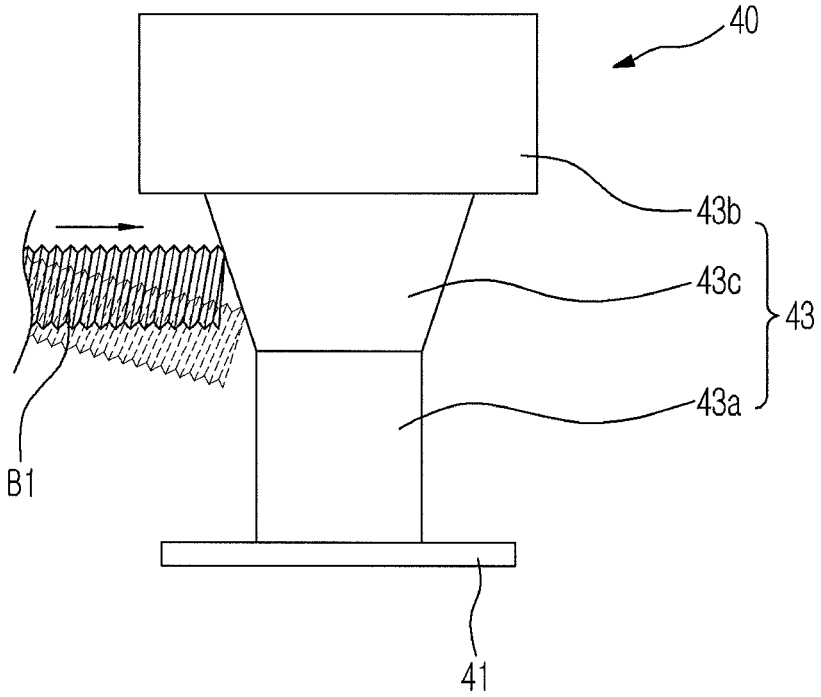
FIG. 3 is a view illustrating fixing of a fastening unit to a first handle fixing unit in accordance with an embodiment.
Figure 4:
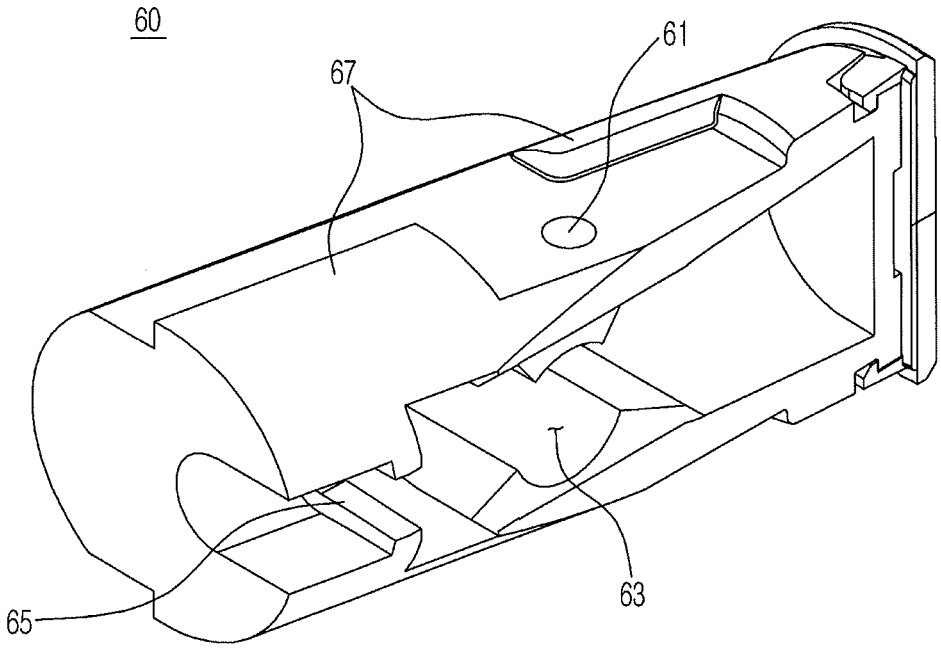
FIG. 4 is a perspective view of a first connector in accordance with an embodiment.

As shown in FIGS. 1 and 3, the first handle fixing unit 40 is assembled with the door 20 and combined with the upper portion of the handle 30.

The first handle fixing unit 40 includes a combining part 41 combined with the door 20, and an insertion part 43 protruded from the front surface of the combining part 41 and inserted into the first connector 60.

The insertion part 43 includes a body part 43*a* connected to the combining part 41 and protruded from the front surface of the combining part 41, a head part 43*b* protruded from the front surface of the body part 43*a* so as to have a greater diameter than the body part 43*a*, and an inclined part 43*c* inclined such that the diameter thereof is gradually decreased in a direction from the lower portion of the head part 43*b* toward the combining part 41.

A first fastening hole 61 and the second fastening hole 31 are provided on the first connector 60 and the upper portion of the handle 30 combined with the first handle fixing unit 40 at positions corresponding to the inclined part 43*c*.

The front end of the fastening unit B1 inserted into the first fastening hole 61 and the second fastening hole 31 provided on the first connector 60 and the upper portion of the handle 30 contacts the inclined part 43*c* of the first handle fixing unit 40.

The front end of the fastening unit B1 contacting a portion of the inclined part 43*c* having a large diameter moves to a portion of the inclined part 43*c* having a small diameter along the inclined surface of the inclined part 43*c*, thus fixing the first connector 60 combined with the handle 30 to the first handle fixing unit 40.

The first handle fixing unit 40 and the handle 30 are combined by assembling the first connector 60 with the upper portion of the handle 30, inserting the insertion part 43 of the first handle fixing unit 40 into an insertion recess 63 of the first connector 60, and fixing the front end of the fastening unit B1 to the inclined part 43*c* of the first handle fixing unit 40 by inserting the fastening unit B1 into the first fastening hole 61 provided on the first connector 60 and the second fastening hole 31 provided on the upper portion of the handle 30.

As shown in FIG. 1, the second handle fixing unit 50 is assembled with the door 20 and combined with the lower portion of the handle 30.

The second handle fixing unit 50 includes a combining part 51 combined with the door 20, and an insertion part 53 protruded from the front surface of the combining part 51 and inserted into the second connector 70.

The insertion part 53 includes a body part 53*a* connected to the combining part 51 and protruded from the front surface of the combining part 51, and a head part 53*b* protruded from the front surface of the body part 53*a* so as to have a greater diameter than the body part 53*a*.

The second handle fixing unit 50 and the handle 30 are combined by assembling the second connector 70 with the lower portion of the handle 30, inserting the insertion part 53 of the second handle fixing unit 50 into an insertion recess 71 of the second connector 70, and slidably moving the body part 53*a* along a guide groove 73 of the second connector 70 formed so as to have a size corresponding to the diameter of the body part 53*a*.

As shown in FIG. 1 and FIGS. 4 to 6, the first connector 60 is combined with the upper portion of the handle 30, and is combined with the first handle fixing unit 40 assembled with the door 20 by the fastening unit B1.

The first connector 60 which is accommodated in the vacant inner space of the handle 30 includes the insertion recess 63 into which the insertion part 43 of the first handle fixing unit 40 is inserted, the first fastening hole 61 provided at a position corresponding to the inclined part 43*c* provided on the first handle fixing unit 40, a fastening groove 65 fastened to the fastening part 33 of the handle 30 by a fastening member B2, and guide parts 67 guided by the guide rails 35 of the handle 30 so that the first connector 60 may be easily inserted into the handle 30.

The handle 30 and the first connector 60 are combined by inserting the first connector 60 into the vacant inner space of the handle 30 so that the fastening part 33 of the handle 30 and the fastening groove 65 of the first connector 60 coincide with each other.

At this time, the guide parts 67 of the first connector 60 move along the guide rails 35 of the handle 30, thereby facilitating insertion of the first connector 60 into the vacant inner space of the handle 30.

When the first connector 60 is inserted into the vacant inner space of the handle 30 so that the fastening part 33 of the handle 30 and the fastening groove 65 of the first connector 60 coincide with each other, the first connector 60 is combined with the handle 30 through fastening between the fastening groove 65 and the fastening part 33 using the fastening member B2.

The first connector 60 assembled with the upper portion of the handle 30 and the first handle fixing unit 40 assembled with the door 20 are combined by fixing the front end of the fastening unit B1 to the inclined part 43*c* of the first handle fixing unit 40, as shown in FIG. 3, by inserting the fastening unit B1 into the first fastening hole 61 formed through the side surface of the insertion recess 63 of the first connector 60 and the second fastening hole 31 provided on the upper portion of the handle 30.

As shown in FIG. 1 and FIGS. 7 to 10, the second connector 70 is combined with the lower portion of the handle 30, and is combined with the second handle fixing unit 60 assembled with the door 20 in a sliding manner.

The second connector 70 which is accommodated in the vacant inner space of the handle 30 includes the insertion recess 71 having a size corresponding to the diameter of the head part 53*b* of the second handle fixing unit 50 so that the insertion part 53 of the second handle fixing unit 50 may be inserted into the insertion groove 71, the guide groove 73 having a size corresponding to the diameter of the body part 53*a* of the second handle fixing unit 50 and guiding movement of the body part 53*a*, a fastening groove 75 fastened to the fastening part 33 of the handle 30 by a fastening member B2, and guide parts 77 guided by the guide rails 35 of the handle 30 so that the second connector 70 may be easily inserted into the handle 30.

The handle 30 and the second connector 70 are combined by inserting the second connector 70 into the vacant inner space of the handle 30 so that the fastening part 33 of the handle 30 and the fastening groove 75 of the second connector 70 coincide with each other.

At this time, the guide parts 77 of the second connector 70 move along the guide rails 35 of the handle 30, thereby facilitating insertion of the second connector 70 into the vacant space of the handle 30.

When the second connector 70 is inserted into the vacant inner space of the handle 30 so that the fastening part 33 of the handle 30 and the fastening groove 75 of the second connector 70 coincide with each other, the second connector 70 is combined with the handle 30 through fastening between the fastening groove 75 and the fastening part 33 using the fastening member B2.

The second connector 70 assembled with the lower portion of the handle 30 and the second handle fixing unit 50 assembled with the door 20 are combined in the sliding manner by moving the handle 30 in the downward direction so that the body part 53*a* of the second handle fixing unit 50 is guided along the guide groove 73 of the second connector 70, after insertion of the insertion part 53 of the second handle fixing unit 50 into the insertion recess 71 of the second connector 70.

Figure 11:
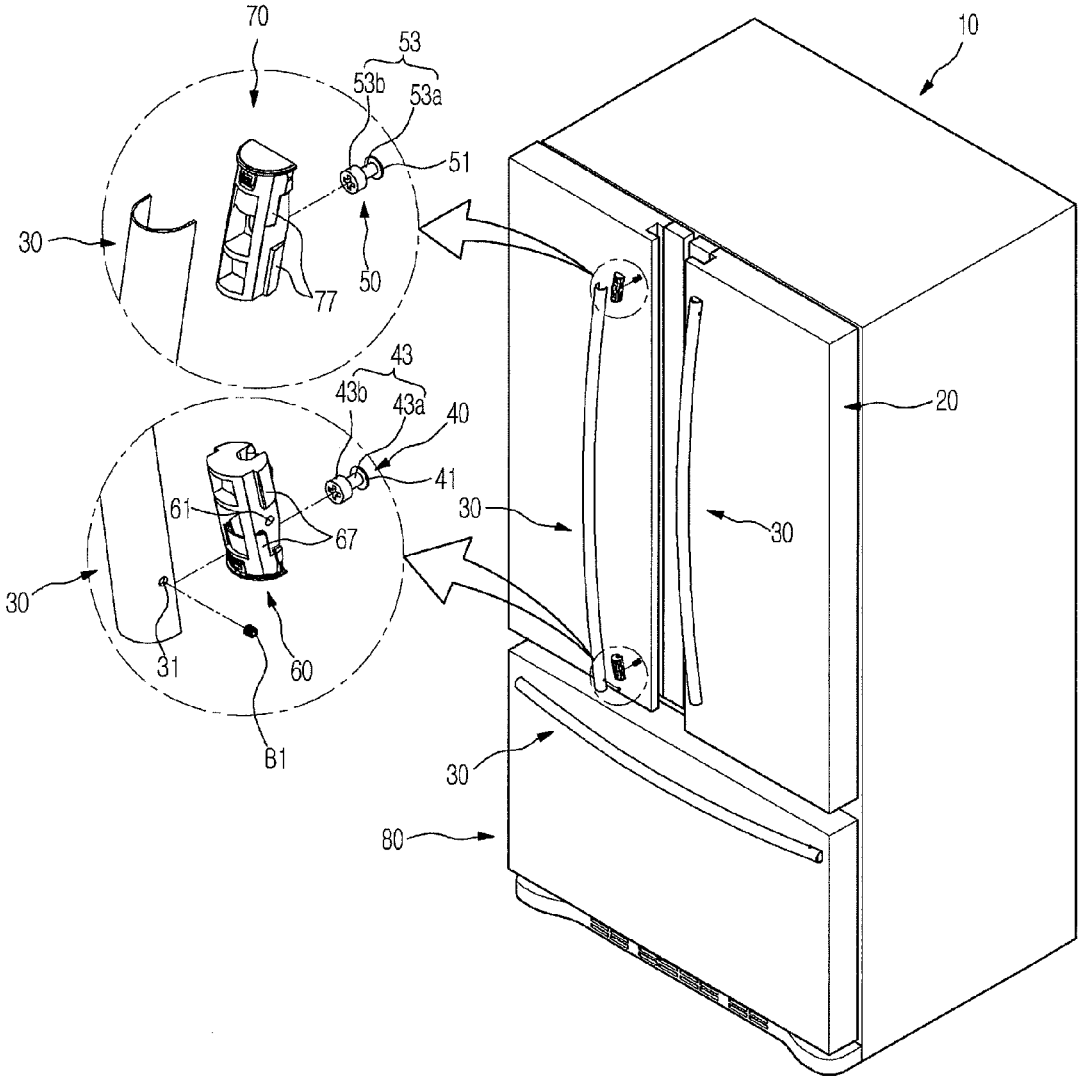
FIGS. 11 to 13 are perspective views of refrigerators in accordance with embodiments.

As shown in FIG. 11, the first handle fixing unit 40 may be assembled with the door 20 and combined with the lower portion of the handle 30, and the second handle fixing unit 50 may be assembled with the door 20 and combined with the upper portion of the handle 30.

If the first handle fixing unit 40 is combined with the lower portion of the handle 30, the first connector 60 is assembled with the lower portion of the handle 30, and is then combined with the first handle fixing unit 40 by the fastening unit B1.

Combining of the lower portion of the handle 30 with the first handle fixing unit 40 by combining the first connector 60 and the first handle fixing unit 40 by the fastening unit B1 is the same as the combining manner of the upper portion of the handle 30 with the first handle fixing unit 40.

If the second handle fixing unit 50 is combined with the upper portion of the handle 30, the second connector 70 is assembled with the upper portion of the handle 30, and is then combined with the second handle fixing unit 50 in the sliding manner.

Combining of the upper portion of the handle 30 with the second handle fixing unit 50 by combining the second connector 70 and the second handle fixing unit 50 in the sliding manner is the same as combining of the lower portion of the handle 30 with the second handle fixing unit 50.

Figure 12:
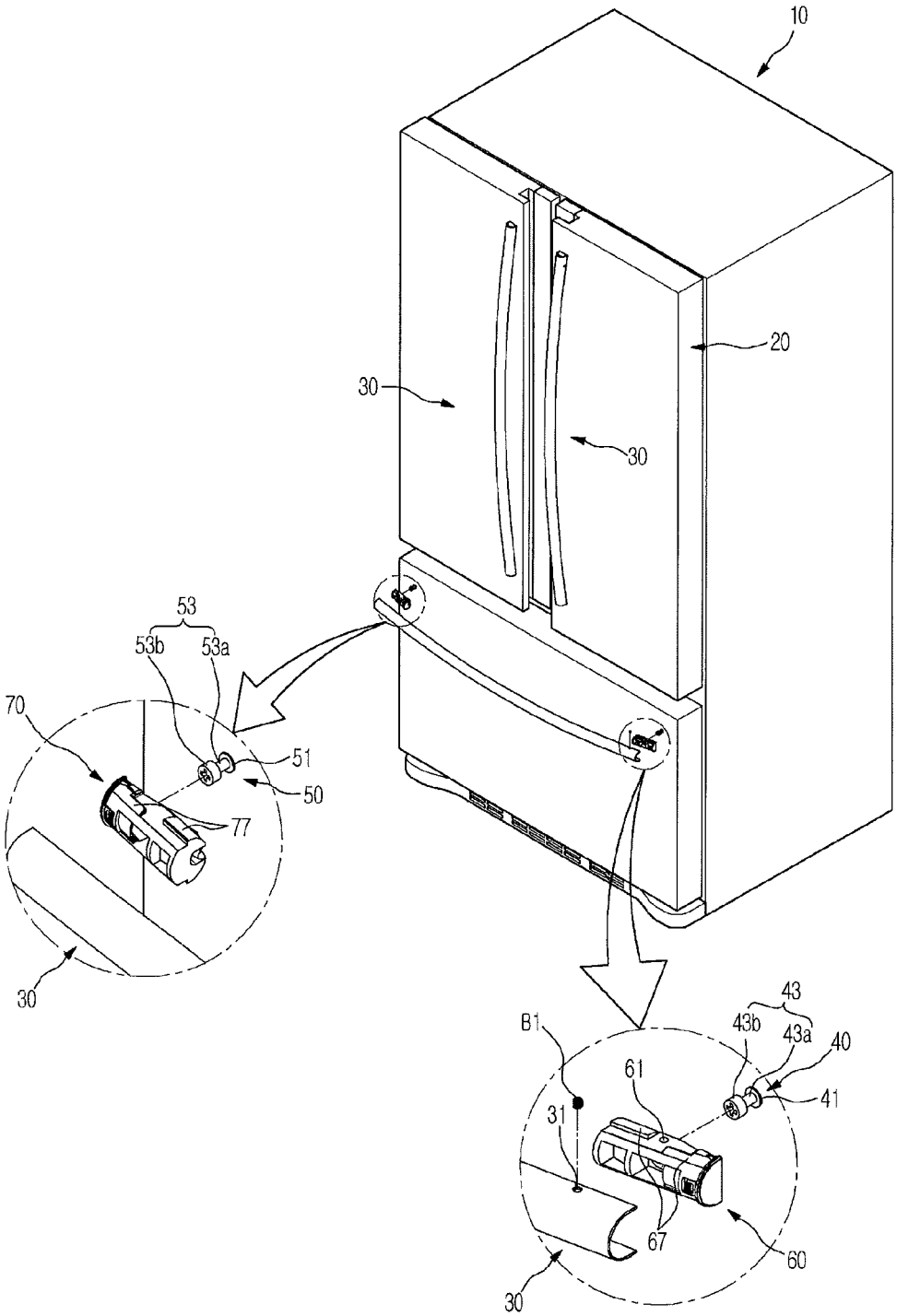

As shown in FIG. 12, the first handle fixing unit 40 may be assembled with the drawer 80 and combined with the right portion of the handle 30, and the second handle fixing unit 50 may be assembled with the drawer 80 and combined with the left portion of the handle 30.

If the first handle fixing unit 40 is combined with the right portion of the handle 30, the first connector 60 is assembled with the right portion of the handle 30, and is then combined with the first handle fixing unit 40 by the fastening unit B1.

Combining of the right portion of the handle 30 with the first handle fixing unit 40 by combining the first connector 60 and the first handle fixing unit 40 by the fastening unit B1 is the same as combining of the upper or lower portion of the handle 30 with the first handle fixing unit 40.

If the second handle fixing unit 50 is combined with the left portion of the handle 30, the second connector 70 is assembled with the left portion of the handle 30, and is then combined with the second handle fixing unit 50 in the sliding manner.

Combining of the left portion of the handle 30 with the second handle fixing unit 50 by combining the second connector 70 and the second handle fixing unit 50 in the sliding manner is the same as combining of the upper or lower portion of the handle 30 with the second handle fixing unit 50.

Figure 13:
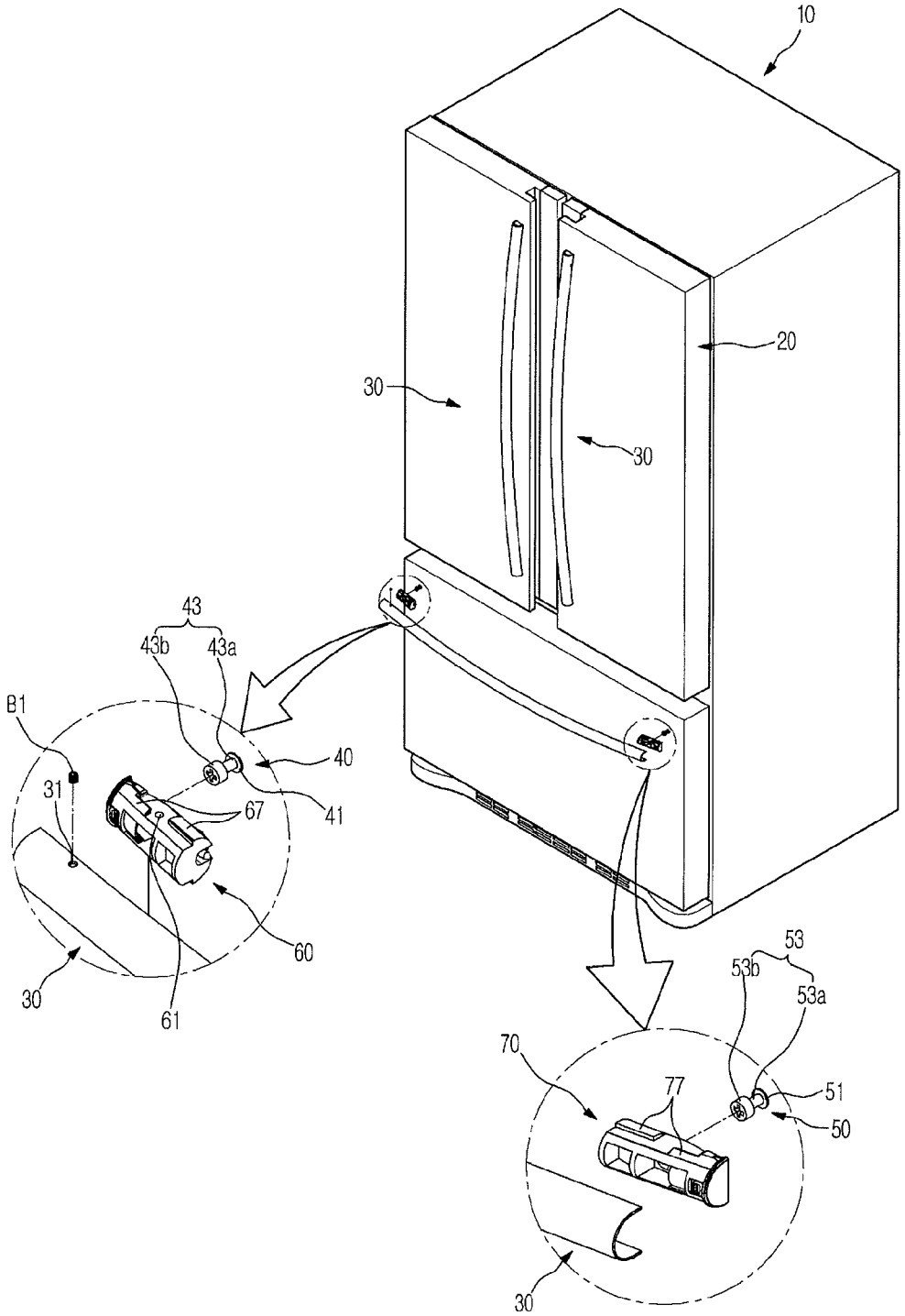

As shown in FIG. 13, the first handle fixing unit 40 may be assembled with the drawer 80 and combined with the left portion of the handle 30, and the second handle fixing unit 50 may be assembled with the drawer 80 and combined with the right portion of the handle 30.

If the first handle fixing unit 40 is combined with the left portion of the handle 30, the first connector 60 is assembled with the left portion of the handle 30, and is then combined with the first handle fixing unit 40 by the fastening unit B1.

Combining of the left portion of the handle 30 with the first handle fixing unit 40 by combining the first connector 60 and the first handle fixing unit 40 by the fastening unit B1 is the same as combining of the right portion of the handle 30 with the first handle fixing unit 40.

If the second handle fixing unit 50 is combined with the right portion of the handle 30, the second connector 70 is assembled with the right portion of the handle 30, and is then combined with the second handle fixing unit 50 in the sliding manner.

Combining of the right portion of the handle 30 with the second handle fixing unit 50 by combining the second connector 70 and the second handle fixing unit 50 in the sliding manner is the same as combining of the left portion of the handle 30 with the second handle fixing unit 50.

Hereinafter, with reference to FIGS. 1 to 13, a handle assembly method of the refrigerator will be described.

First, as shown in FIG. 1, the first handle fixing unit 40 and the second handle fixing unit 50 are assembled with positions of the door 20 corresponding to the upper and lower portions of the handle 30.

When the first handle fixing unit 40 and the second handle fixing unit 50 are assembled with the door 20, the first connector 60 and the second connector 70 are assembled with the upper and lower portions of the handle 30.

Combination between the handle 30 and the first and second connectors 60 and 70 is achieved by fastening the fastening grooves 65 and 75 provided on the first connector 60 and the second connector 70 and the fastening parts 33 of the handle 30 using the fastening members B2 after coincidence between the fastening grooves 65 and 75 and the fastening parts 33.

Figure 5:
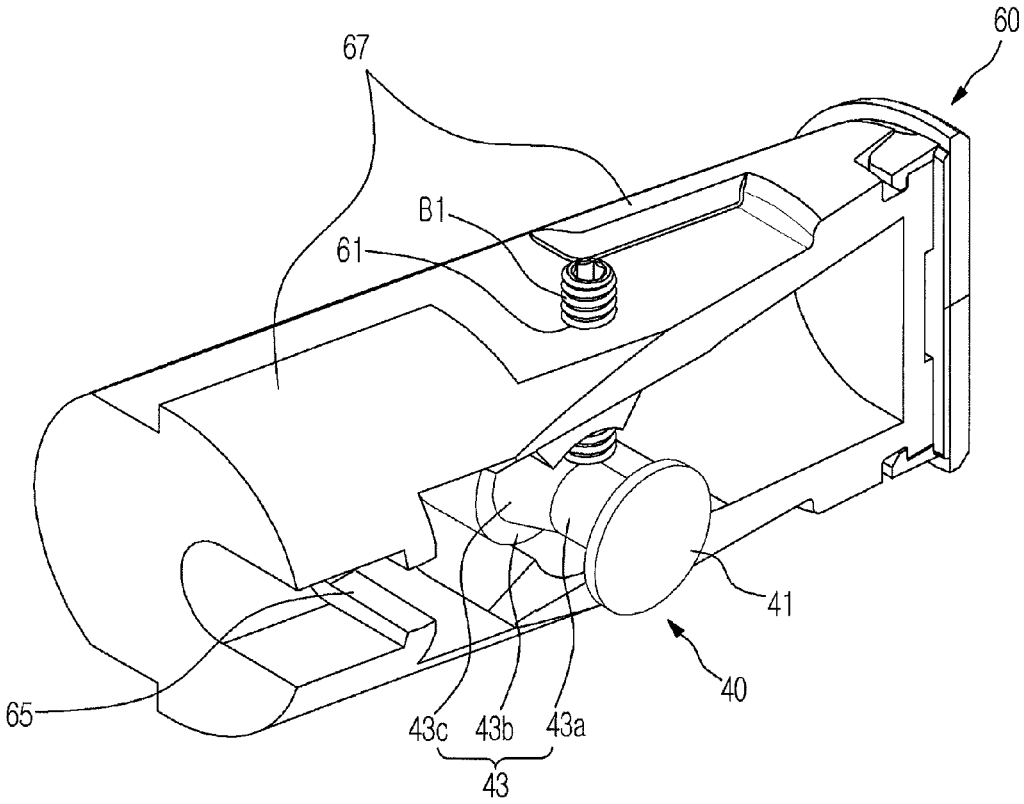
FIG. 5 is a view illustrating combining of the first handle fixing unit with the first connector in accordance with an embodiment.
Figure 6:
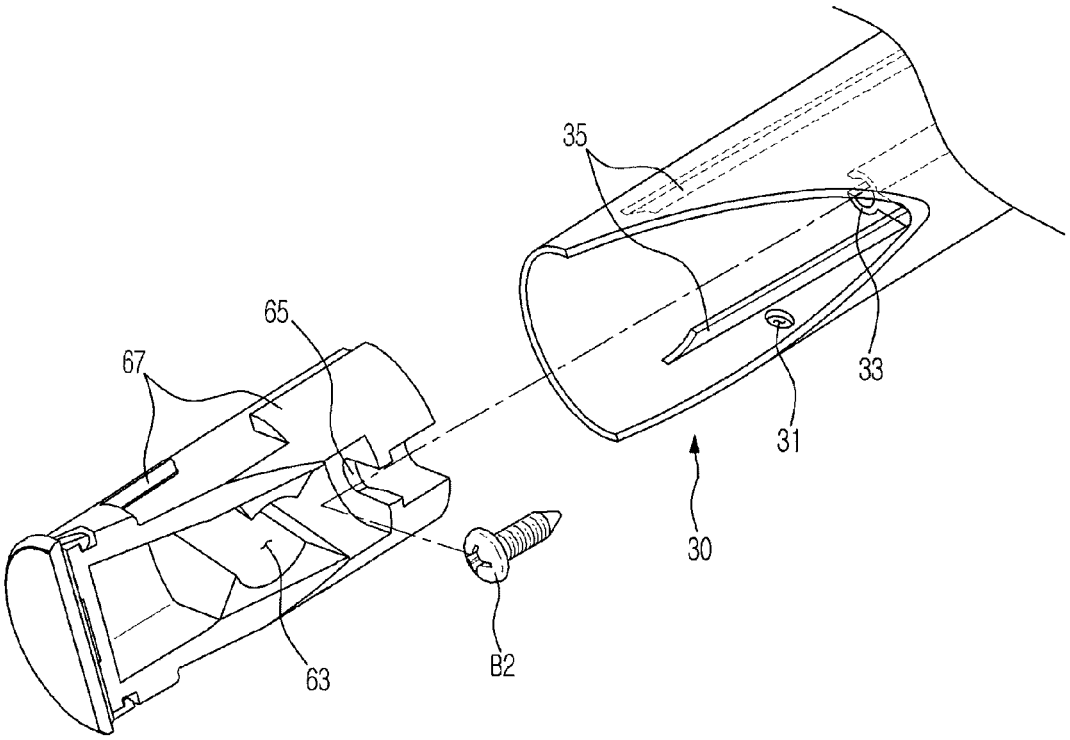
FIG. 6 is a view illustrating combining of the first connector with the handle in accordance with an embodiment.
Figure 7:
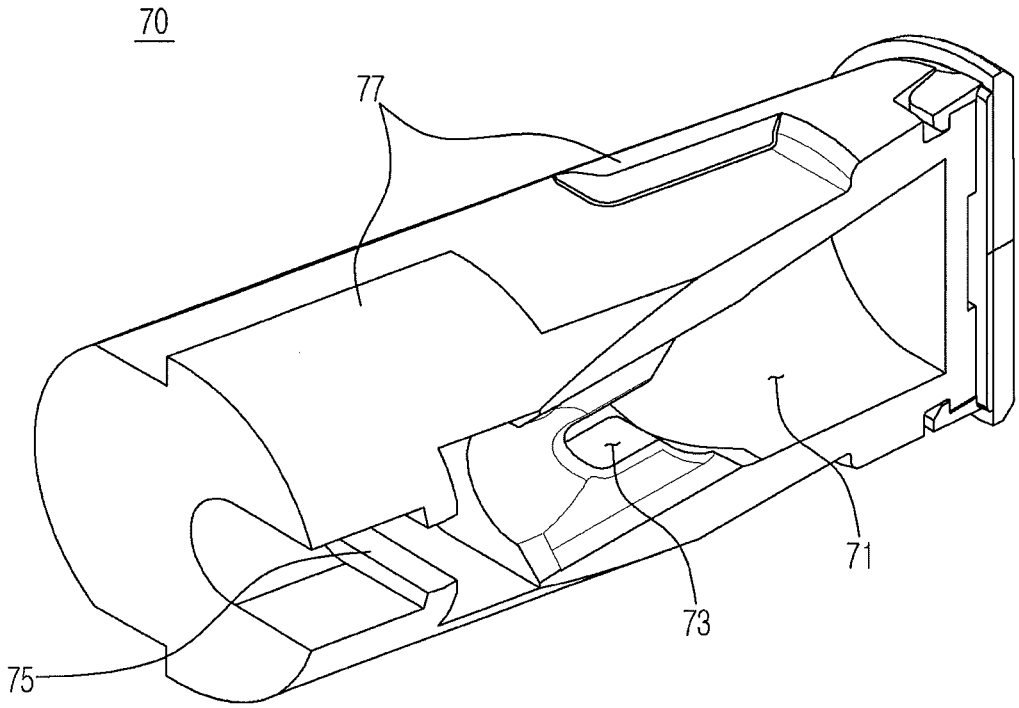
FIG. 7 is a perspective view of a second connector in accordance with an embodiment.
Figure 8:
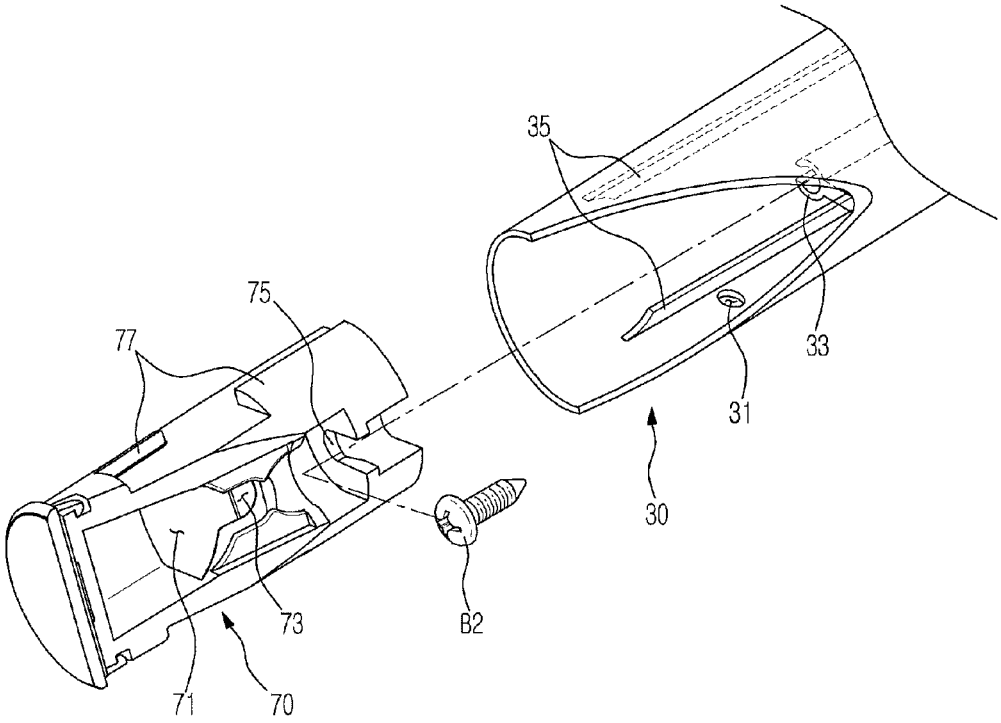
FIG. 8 is a view illustrating combining of the second connector with the handle in accordance with an embodiment.
Figure 9:
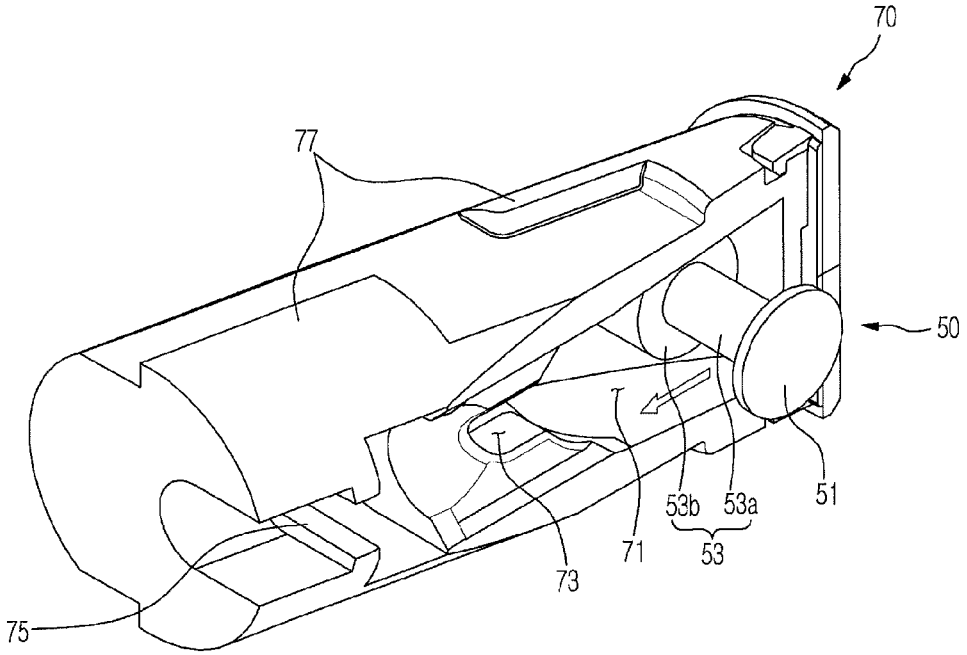
FIGS. 9 and 10 are views illustrating combining of a second handle fixing unit with the second connector in accordance with an embodiment.
Figure 10:
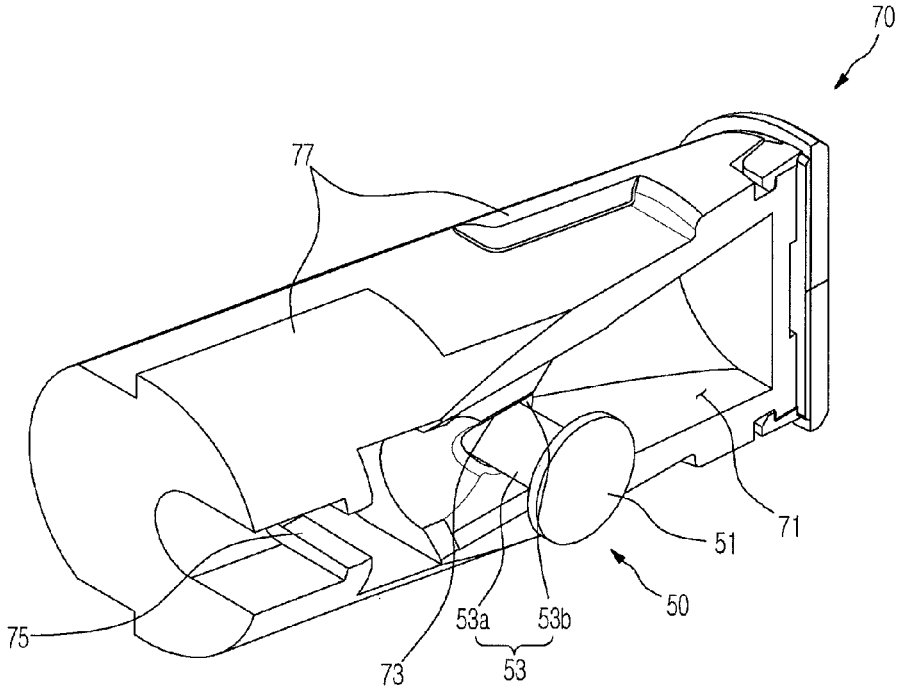

When the first connector 60 and the second connector 70 are assembled with the handle 30, the body part 53*a* of the second handle fixing unit 50 is inserted into the guide groove 73 of the second connector 70 in the sliding manner by moving the handle 30 toward the lower portion of the door 20 with which the second handle fixing unit 50 is assembled, after insertion of the insertion part 53 of the second handle fixing unit 50 into the insertion recess 71 of the second connector 70 assembled with the lower portion of the handle 70, as shown in FIGS. 5 and 6.

Here, interference between the upper portion of the handle 30 and the first handle fixing unit 40 is prevented by inserting the insertion part 53 of the second handle fixing unit 50 into the insertion recess 71 of the second connector 70, after drawing of the upper portion of the handle 30 in the forward direction.

When the second handle fixing unit 50 is combined with the second connector 70, the insertion part 43 of the first handle fixing unit 40 is inserted into the insertion recess 63 of the first connector 60 assembled with the upper portion of the handle 30, as shown in FIGS. 1 to 3.

When the insertion part 43 of the first handle fixing unit 40 is inserted into the insertion recess 63 of the first connector 60, the upper portion of the handle 30 and the first handle fixing unit 40 are combined by inserting the fastening unit B1 into the first fastening hole 61 provided on the first connector 60 and the second fastening hole 31 provided on the upper portion of the handle 30 and then fixing the front end of the fastening unit B1 to the inclined part 43*c* of the first handle fixing unit 40. Thereby, the handle 30 is assembled with the door 20.

Even if the assembly positions of the first handle fixing unit 40 and the second handle fixing unit 50 are changed, as shown in FIGS. 11 to 13, the above-described assembly method may be carried out regardless of the assembly positions. That is, the handle 30 may be assembled with the door 20 or the drawer 80 by combining the second handle fixing unit 50 with the second connector 70 assembled with the handle 30 in the sliding manner, and then combining the first handle fixing unit 40 with the first connector 60 assembled with the handle 30 using the fastening unit B1.

As is apparent from the above description, a refrigerator and a handle assembly method thereof in accordance with an embodiment increase convenience in assembly of a handle and improve the external appearance of the refrigerator.

Although a few embodiments of have been shown and described, it would be appreciated by those skilled in the art that changes may be made in these embodiments without departing from the principles and spirit of the disclosure, the scope of which is defined in the claims and their equivalents.

What is claimed is:

1. A handle assembly method of a refrigerator which has a main body, doors rotatably combined with the main body and opening and closing the main body, and a handle combined with each door to open and close each door, the handle assembly method comprising:

assembling a first handle fixing unit and a second handle fixing unit with positions for each door corresponding to respective ends of the handle;

assembling a first connector and a second connector with respective ends of the handle;

inserting a body part of the second handle fixing unit into a guide groove of the second connector by slidably moving the handle toward an assembly position of the second handle fixing unit for each door, after insertion of an insertion part of the second handle fixing unit into an insertion recess of the second connector assembled with one end of the handle; and inserting an insertion part of the first handle fixing unit into an insertion recess of the first connector assembled with the other end of the handle, and then combining the handle with the first handle fixing unit by a fastening unit, wherein the handle for each door includes guide members to guide the first connector to connect with the handle at the one end of the handle and to guide the second connector to connect with the handle at the other end of the handle, and wherein interference between the other end of the handle and the first handle fixing unit is prevented by inserting the insertion part of the second handle fixing unit into the insertion recess of the second connector after moving an upper portion of the handle in a forward direction.

* * * * *